US007152438B2

(12) United States Patent
Matsuda

(10) Patent No.: US 7,152,438 B2
(45) **Date of Patent: *Dec. 26, 2006**

(54) SLIDE FASTENER TAPE AND SLIDE FASTENER STRINGER USING THE SAME TAPE

(75) Inventor: Yoshio Matsuda, Toyama-ken (JP)

(73) Assignee: YKK Corporation, Tokyo (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 94 days.

(21) Appl. No.: 10/831,389

(22) Filed: Apr. 23, 2004

(65) Prior Publication Data

US 2004/0244157 A1 Dec. 9, 2004

(30) Foreign Application Priority Data

May 30, 2003 (JP) ..... 2003-154887

(51) Int. Cl.
*D04B 21/14* (2006.01)

(52) U.S. Cl. ..... 66/192; 66/195

(58) Field of Classification Search ..... 66/190, 66/195, 192, 193, 170; 24/391, 392, 398
See application file for complete search history.

(56) References Cited

U.S. PATENT DOCUMENTS 3,951,181 A * 4/1976 Tsubata ..... 139/384 B
4,401,138 A * 8/1983 Takahashi et al. ..... 139/384 B
6,180,545 B1 * 1/2001 Okeya et al. ..... 66/192
6,886,368 B1 * 5/2005 Matsuda ..... 66/192
2004/0173276 A1 * 9/2004 Horikawa ..... 139/384 B

FOREIGN PATENT DOCUMENTS

DE 25 02 496 A1 7/1975
DE 31 29 945 A1 4/1982
EP 1 224 883 A2 7/2002

* cited by examiner

*Primary Examiner*—Danny Worrell
(74) *Attorney, Agent, or Firm*—Everest Intellectual Property Law Group; Michael S. Leonard

(57) ABSTRACT

This invention provides a fastener tape and a stinger for a slide fastener constituted of a warp knitting or weaving structure and including a tape main portion and a fastener element attaching portion, wherein a warp and a weft, which are composition yarns of the fastener tape, are composed of multifilament yarns and a size of a composition filament of the warp is 1.0 to 2.0 dTex, and a size of that of the weft is 2.0 to 5.0 dTex, these sizes of the single filaments being not larger than ¼ of the conventional composition filament, thereby achieving advantages that they adapt well to a fabric when and after a slide fastener is sewed to a thin fabric having flexibility and excellent drape performance and secure tape strength and coupling strength required as a slide fastener, the fastener tape and stringer ensuring flexibility and soft feeling.

8 Claims, 7 Drawing Sheets

SLIDE FASTENER TAPE AND SLIDE FASTENER STRINGER USING THE SAME TAPE

BACKGROUND OF THE INVENTION

1. Field of the Invention

The present invention relates to a slide fastener knit/woven tape and a slide fastener stringer in which fastener elements are attached to the same tape, and more specifically to a slide fastener knit/woven tape which allows the fastener elements to be sewed to the fastener tape easily and accurately and has excellent drape performance, flexibility and excellent texture, and a slide fastener stringer which employs the same tape and ensures high coupling strength.

2. Description of the Related Art

Usually, conventional slide fastener tapes have been manufactured by weaving with a narrow width weaving machine or by knitting with a warp knitting machine. The slide fastener stringers (hereinafter referred to as stringer) on which various kinds of fastener elements are attached are manufactured according to any one of the following methods. One method is to attach coil-like or zigzag-like continuous elements made of synthetic resin along an fastener element attaching portion disposed on one side edge of the fastener tape by sewing. Another method is to weave or knit a monofilament of a single body in which element coupling heads, upper/lower leg portions extending from both ends of the coupling heads and connecting portion for connecting the ends of the upper/lower leg portions between adjoining fastener elements are formed by a stamping forming method or the like, at the same time when the fastener tape is knit or woven. Another method is to implant a number of metallic or synthetic resin elements into a fastener tape in which a core thread is knit or woven.

Multifilament yarns composed of polyester are generally used as materials of these fastener tapes. The sizes of the multifilament yarns are usually, 110 dTex-24 f, 167 dTex-36 f, 330 dTex-72 f, 501 dTex-108 f and the like. In all cases, the size of a single composition filament constituting the multifilament is as large as 4.6 dTex. In case of the woven tape, the number of driving wefts (driving frequency/2.54 cm) is 40 to 60 (the number of driving wefts/2.54 cm). Although in case of the knit tape, a relatively thin yarn (78 dTex-24 f and the like) is used for yarns which constitute wales of chain knitting yarn or tricot knitting yarn, a thick yarn whose single yarn size exceeds 4.6 dTex, such as 110 dTex-24 f and 167 dTex-36 f, is employed for an weft in-laid yarn. Further, the same kind of yarn as the one used in the knit/woven tape is used as the composition yarn of the core thread (twisted thread, or knit cord), for which yarns of 167 dTex-36 f, 330 dTex-72 f, and 501 dTex-108 f are combined.

The slide fastener tape and stringer produced of these filaments having large single yarn size have high rigidity and excellent fastener strength, and are easy to be attached and sewed to a heavy foundation fabric or a fabric made of a relatively hard material used in a shoe and a bag. In this case, the stringer itself is rigid and therefore there is a balance between the stringer and the foundation fabric. However, fashionable woman's clothes, child's clothes and the like having an excellent drape performance have been more preferred recently.

If the above-described rigid slide fastener is sewed on such clothes having flexibility and excellent drape performance, a discomfort feeling is generated because the rear surface of the fastener makes a direct contact with the skin. Further, if the slide fastener to be attached by sewing on a soft foundation fabric is hard, the foundation fabric warps back due to the hardness and stretching phenomenon occurs. It prevents a beautiful curve along the waist portion and back portion of a one-piece dress, skirt and the like and thus improvement is demanded.

As for a conventional method for softening the stringer or fastener tape, for example, in case of the woven tape, a stringer having flexibility is produced by lowering the weft driving density (quantity of wefts) or carrying out a special processing such as depletion processing, softening processing with alkaline solution or the like in dying process. However, this processing cannot avoid an increase in production cost and a reduction in strength of the slide fastener.

The present invention has been achieved to solve the above-described problem and a specific object of the invention is to provide a fastener tape and fastener tape stringer which adapt well to a fabric having flexibility and excellent drape performance when and after a slide fastener is sewed on the fabric, and which secure tape strength and coupling strength required as a slide fastener and have a flexibility and a soft feeling at the same time.

SUMMARY OF THE INVENTION

A fastener tape and stringer of a slide fastener of the present invention are obtained by weaving or knitting. The weaving produces a woven fabric by bringing up and down part of a number of warp weaving yarns arranged along its weaving structure so as to create an opening and then driving a weft weaving yarn into the opening. Because the fastener tape is usually woven with a narrow weaving machine using a carrier or the like, the weft weaving yarn reciprocates within the same opening so as to form a single weft weaving yarn. Therefore, in the fastener tape woven with such a narrow weaving machine, two yarns are combined to form a single weft yarn.

On the other hand, most of fastener tape obtained by knitting are warp knit tape. This warp knit tape is comprised of a warp knitting yarn such as a chain knitting yarn or a tricot knitting yarn which extends in a length direction of the tape along the knitting structure and forms a stitch in each course so as to form a wale, and a weft knitting yarn such as a weft in-laid yarn and satin knitting yarn which extends in a width direction of the tape connecting between adjoining wales so as to form a course.

Thus, the "warp" mentioned in the present invention includes a warp weaving yarn in case of a woven tape and includes a warp knitting yarn such as a chain knitting yarn and tricot knitting yarn in case of a knit tape. The "weft" mentioned in the present invention includes a weft weaving yarn in case of the woven tape and a weft knitting yarn such as a weft in-laid yarn in case of the knit tape.

According to a first aspect of the present invention, there is provided a fastener tape for a slide fastener, which is constituted of a warp knitting structure or weaving structure and comprised of a tape main portion and a fastener element attaching portion, wherein a warp and a weft, which are composition yarns of the fastener tape, are composed of multifilament yarns, a size of a single composition filament of the warp is 1.0 to 2.0 dTex, and a size of a single composition filament of the weft is 2.0 to 4.5 dTex.

The feature of the present invention exists in using multifilament yarns constituted of a number of filaments having a very small size which has never used conventionally for the warp or weft. Although a size in a single filament of this kind of the conventional yarn is 4.6 dTex or more in case of the warp and weft as described above, at least the warp of the present invention employs a fine filament of 1.0 to 2.0 dTex in size, which is not larger than ½ the conventional yarn size. As for the weft, although a filament which is 5.0 dTex in size at maximum can be used, the size of a filament usually used is 2.0 dTex to 4.0 dTex. Further, a total size of the multifilament yarn of the present invention is not different from that of the conventional warp and weft.

According to the present invention, although a yarn having a size not different from that of the conventional yarn is used for the warp and weft, a number of filaments each having a size which is not larger than ½ of a conventional filament are used as composition filaments of the warp at least. In addition, a number of filaments whose sizes are the smallest in conventional filaments are used as the composition filaments of the weft. Consequently, the knit/woven tape obtained by knitting or weaving has flexibility and excellent drape performance, so that even when the stringer is sewed onto a thin and flexible fabric, the slide fastener adapts well to the fabric, thereby showing a beautiful waistline. Furthermore, according to the present invention, it is preferable to use the composition filaments whose sizes are as small as possible for the warp and weft. For the reason, it is further preferable to use the composition filaments whose sizes are 2.0 to 4.5 dTex for the weft. The multifilament yarn used for the present invention is preferred to be substantially not twisted in order to secure flexibility, soft feeling or drape performance, and particularly a textured yarn is preferred to be used.

Further, according to the present invention, because a multifilament yarn having an ordinary size constituted of a number of filaments each having a very small filament size is used for the warp and weft, although its yarn strength is hardly different from the conventional one, for example, when those yarns are knit or woven into a knit/woven tape, the composition filaments of each yarn are expanded laterally so that they flatten. Thus, even if the weaving or knitting is performed at a rough weaving density or knitting density, no space is generated between the warp and the weft or between stitches, so that a close, stabilized knit/woven tape is obtained. The reason why a filament having a size larger than that of the warp is used as the composition filament of the weft is to provide the tape width direction with some extent of rigidity in order to prevent wrinkles and bending and suppress catching of the fabric. However, a filament having a smaller size than the conventional filament size is employed.

According to the present invention, a dry heat contraction ratio of yarns which constitute the fastener element attaching portion is 10 to 20% and a dry heat contraction ratio of yarns which constitute the tape main portion is 7 to 13%. If the dry heat contraction ratio of the yarns constituting the fastener element attaching portion is set to be higher than that of the yarns constituting the tape main portion, an stretchability in the length direction of the fastener element attaching portion becomes slightly smaller than that in the length direction of the tape main portion due to a difference in contraction at the time of thermally setting, so that a pitch between elements attached along the fastener element attaching portion is stabilized. Consequently, even if a bending force or a pushing force is applied, there occurs no break in coupling between the elements, thereby obtaining required coupling strength. Further, when the main portion of the stringer tape is sewed onto a fabric, the stringer is stretched or contracted corresponding to the stretch/contraction of the fabric to facilitate the sewing of the stringer onto the fabric.

If the dry heat contraction ratio of yarns in the fastener element attaching portion deflects from a range of 10 to 20%, it becomes difficult to obtain an optimum biasing, thereby affecting the flexibility. The biasing mentioned here means a shape in which the fastener element row attachment side edge is inwardly curved in a fastener stringer which is a final product.

According to the present invention, at the same time when a fastener tape is knit or woven, a core thread can be woven or knit into the fastener element attaching portion. As already described, the attachment of elements onto the fastener tape is achieved by sewing, or weaving or knitting into the fabric at the same time. Alternatively, elements composed of metallic unit are attached to the fabric by crimping or elements composed of synthetic resin unit are molded onto a fastener tape by injection molding. As for the last case, when attaching the metallic elements or synthetic-resin molded elements onto the fastener tape, the core thread can be fixed along the fastener element attaching portion preliminarily in order to allow the elements to be attached to the fastener tape firmly. According to the present invention, at the same time when the fastener tape is knit or woven, the core thread, which is a braided thread or a knit thread, is knit or woven along the fastener element attaching portion. As the composition yarn of the core thread, the multifilament yarn constituted of a number of fine filaments is used like other yarns.

According to a second aspect of the present invention, there is provided a slide fastener stringer having a plurality of fastener elements along the fastener element attaching portion of the fastener tape with the aforementioned basic configuration, wherein the plurality of fastener elements are formed by continuously weaving or knitting a single large-sized monofilament into the fastener tape at the same time when the fastener tape is knit or woven, each of the fastener elements is fixed to the fastener element attaching portion with the warp for fixing the fastener element and the warp for fixing the fastener element is constituted of a yarn having a size 1.5 to 5.0 times larger than the warp which is a composition yarn of the tape main portion.

The present invention is premised on the above-described fastener tape, that is, that the warp and weft employ the multifilament yarn constituted of a number of filaments each having a smaller filament size than the conventional filament and a number of fastener elements made of the monofilament are knit or woven into the fastener tape continuously so as to construct a fastener stringer. At this time, in order to fix the fastener elements to the fastener tape, leg portion of each fastener element is tightened and fixed to the foundation structure of the fastener tape with an element fixing yarn disposed in a warp direction together with the warp in the fastener element attaching portion. According to the present invention, as the element fixing yarn, a yarn having a size 1.5 to 5.0 times larger than the warp which is the composition yarn of the tape main portion is used under the above-described premise.

This element fixing yarn is preferred to be a multifilament yarn constituted of a number of fine filaments like the other yarns. If the multifilament yarn constituted of a number of fine filaments is used as the element fixing yarn, not only flexibility in a tape direction is secured, but also when the leg portion of each element is tightened, a number of filaments are expanded in a yarn width direction, so that a pressing force on the leg portion is increased and further the leg portions are covered by the expanded filaments, thereby the leg portions being blocked from being seen from outside. For the reason, this phenomenon is preferable for a hidden type slide fastener in which the elements are hidden inside clothes.

DESCRIPTION OF THE PREFERRED EMBODIMENTS

Hereinafter, preferred embodiments of the present invention will be described in detail with reference to the accompanying drawings.

Figure 2:
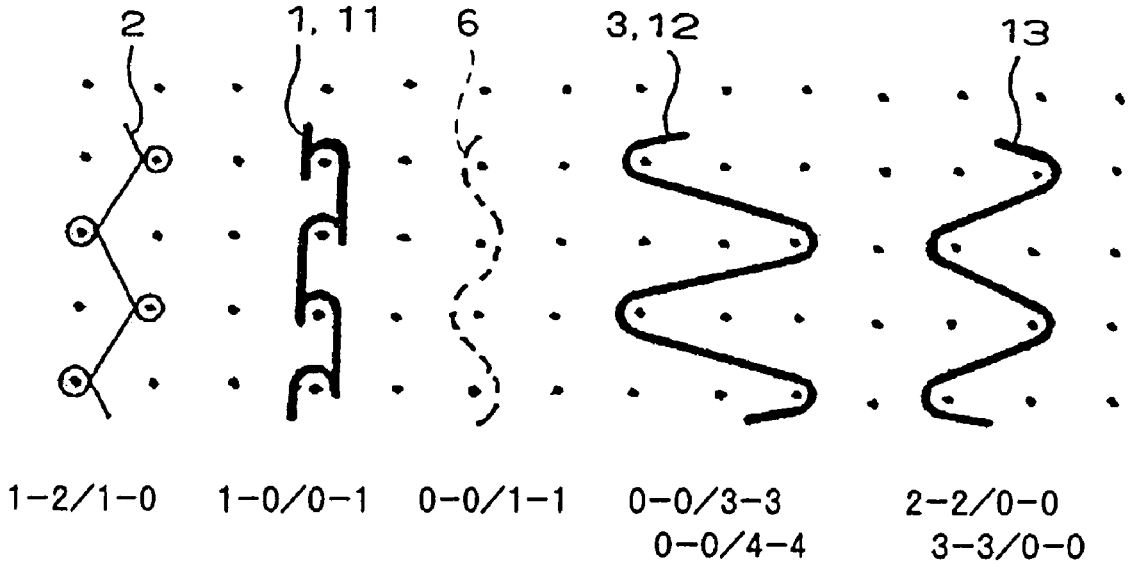
FIG. 2 is a warp knitting structure diagram of each knitting yarn of the stringer.

A knit-in hidden type slide fastener in the present invention is knit by a warp knitting machine such as a Russell knitting machine having a needle bed of one row, and as shown in FIG. 2, the foundation structure of its tape main body A is constituted of a chain knitting yarn 1 of 1-0/0-1, a tricot knitting yarn 2 of 1-2/1-0 and a weft in-laid knitting yarn 3 of 0-0/3-3 which is inserted in a zigzag shape across three wales W of a fastener tape 4. A fastener element attaching portion B constituted of three rows of wales $W_1$ to $W_3$ on a longitudinal edge section of each of a pair of right and left fastener tapes 4, 4, excludes the tricot knitting yarn of 1-2/1-0, but comprises a fixing chain knitting yarn 11 of 1-0/0-1, a weft in-laid knitting yarn 12 of 0-0/3-3 inserted in a zigzag fashion across three wales $W_1$–$W_3$ of the fastener tape 4 and two rows of wales $W_4$, $W_5$ in the tape main body A adjoining the wale $W_3$, and an inverse weft in-laid knitting yarn 13 of 2-2/0-0 which is inserted in a zigzag fashion across the two wales $W_1$, $W_2$ and $W_3$, $W_4$ in the fastener tape 4 such that it intersects the weft in-laid knitting yarn 12 not existing in the tape main body A.

Figure 1:
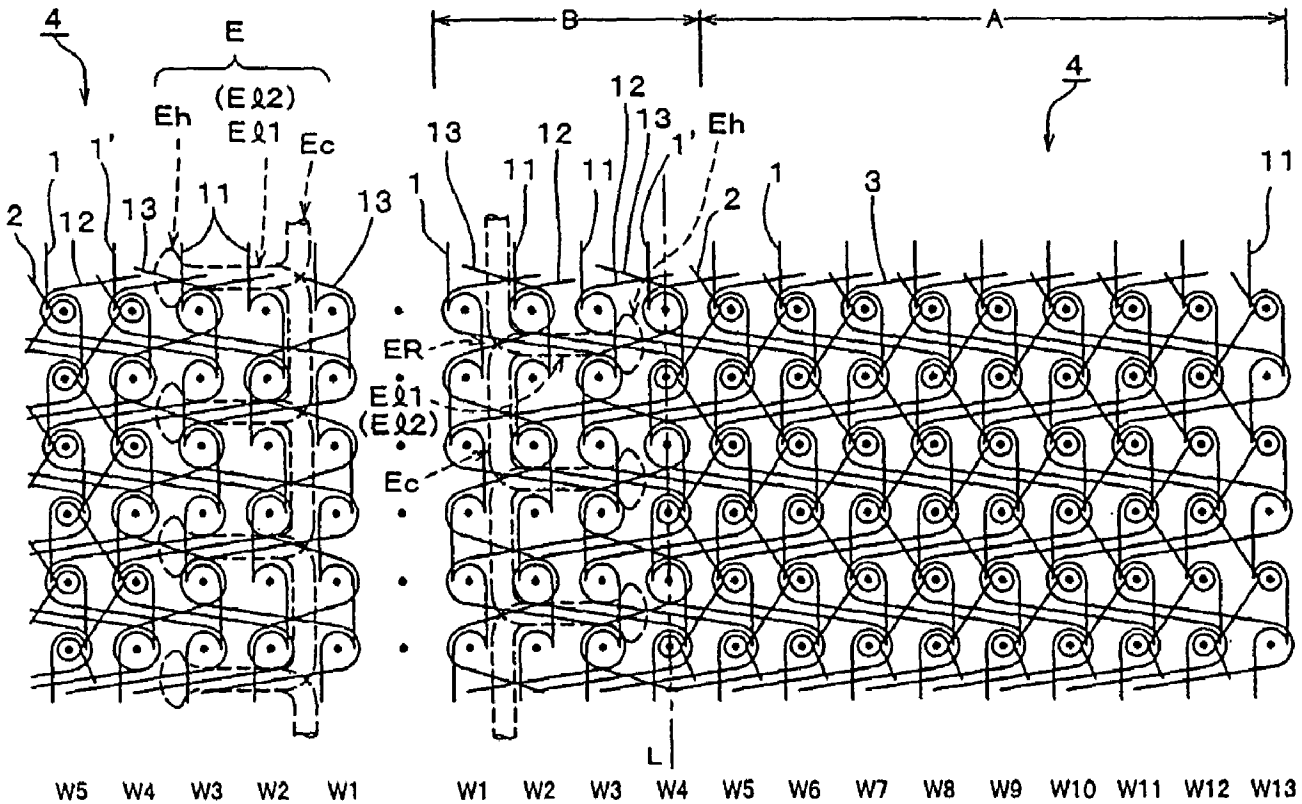
FIG. 1 is an entire warp knitting structure diagram showing an example of a knitting structure of a knit-in hidden type slide fastener stringer of the present invention.
Figure 3:
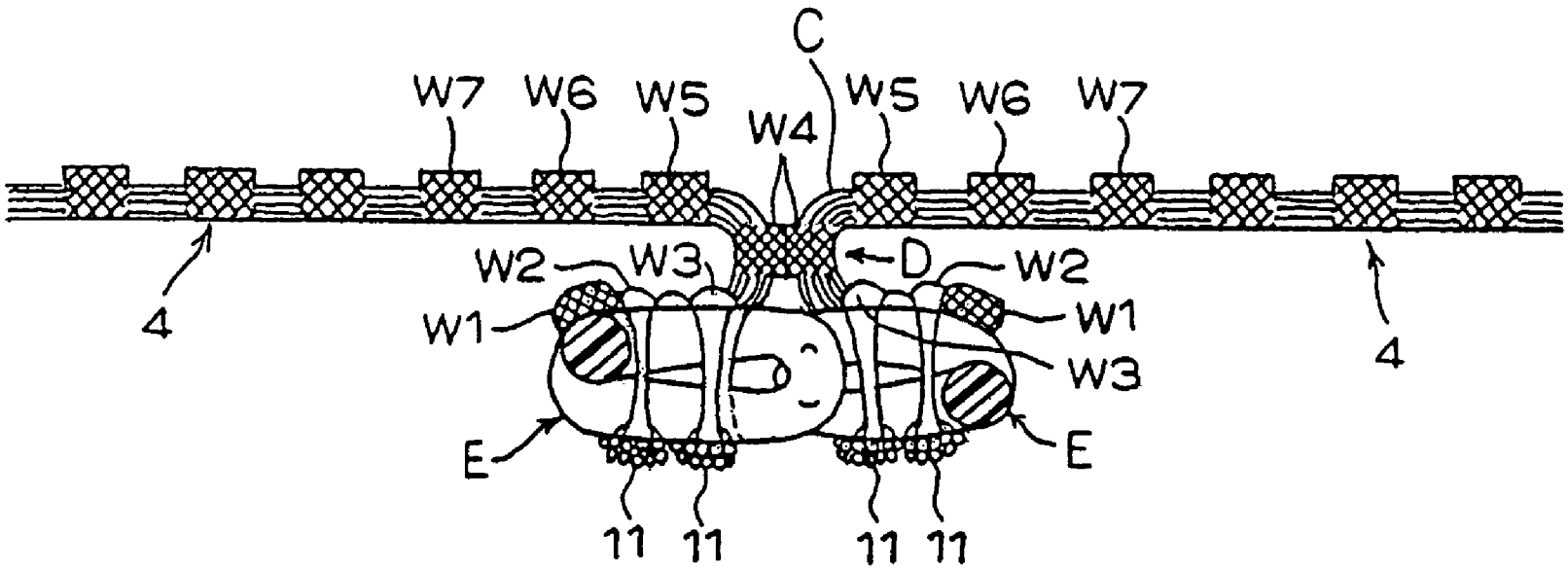
FIG. 3 is a lateral sectional view schematically showing the hidden type slide fastener obtained from the same stringer.

Meanwhile, this knitting structure is not restricted to the structure shown in FIGS. 1 to 3, but for example, a warp in-laid yarn 6 constituted of the structure 0-0/1-1 shown in FIG. 2 or a two-needle knitting yarn of 0-2/2-0 (not shown) may be knit into the wale $W_2$ of the fastener element attaching portion B of the fastener tape 4 and a needle loop of the fixing chain knitting yarn 11 constituting the wale $W_2$ in the zigzag fashion along the warp direction.

On the other hand, a synthetic resin monofilament 5 composed of nylon, polyester or the like is preliminarily formed with a coupling head Eh and a connecting portion Ec that connects adjoining upper/lower leg portions $E1_1$, $E1_2$ with each other, which constitutes a coil-shaped fastener element row ER. Across two wales $W_2$, $W_3$ adjacent the wale $W_1$ disposed most outside in the fastener element attaching portion B, the monofilament 5 runs, with its coupling head Eh directed toward the tape main portion A while its connection section Ec directed to outside of the fastener element attaching portion B, so as to reciprocate in a horizontal direction in the same course with every other course skipped. As indicated with a dotted line in FIG. 1, the upper/lower leg portions $E1_1$, $E1_2$ of each fastener element E are pressed by the needle loops of two fixing chain knitting yarns 11, 11, which is used to fix the element, of 1-0/0-1 in the aforementioned two wales $W_2$, $W_3$ which constitutes the foundation structure of the fastener element attaching portion B. And it is knit in continuously as the fastener element row ER at the same time when the fastener tape is knit.

In a stringer S having such a knitting structure of this embodiment, the fastener tape 4 is bent into a shape of a U shape along a bending line L shown in FIG. 1 with its fastener element row ER disposed outside and thermally set. That is, according to this embodiment, the fastener tape 4 is bent along the wale $W_4$ in the tape main portion A adjacent the wale $W_3$ for fixing the elements which is nearest the tape main portion of the fastener element attaching portion B so as to form a bent portion D. The fastener tape 4 is sewed on an object body along a groove C formed relative to the wale $W_5$ of the tape main portion A adjacent the wale $W_4$.

According to this embodiment, as the knitting yarns (chain knitting yarn 1, tricot knitting yarn 2) of the warp knitting yarn which constitutes the tape main portion A of the fastener stringer (wale $W_5$, $W_6$, . . . $W_{n-1}$), single multifilament yarns of same sizes are used and the size of each yarn is 84 dTex, constituted of 72 fine filaments. That is, the size of each filament of the multifilament yarn which constitutes the chain knitting yarn 1 and tricot knitting yarn 2 that form most part of these foundation structures is as small as 1.0 to 2.0 dTex. On the other hand, the weft in-laid knitting yarn 3 which constitutes the foundation structure employs a bulky processed yarn composed of multifilament and its size is 100 dTex, which is much larger than those of the aforementioned chain knitting yarn 1 and tricot knitting yarn 2. The number of composition filaments is 48, which is smaller than the number of the composition filaments of another knitting yarns. The size of each filament is as large as 2.1 dTex. For the chain knitting yarn which constitutes the wale $W_1$ disposed most outside the fastener element attaching portion B, the same kind of knitting yarn as the chain knitting yarn 1 in the tape main portion A is used. For the chain knitting yarn which constitutes a wale $W_n$ disposed most outside the tape main portion A, the same kind of the knitting yarn as the aforementioned fixing chain knitting yarn is used in order to keep the shape and strength of its edge.

Because the wale formed in most region of the tape main portion A is formed by the chain knitting yarn 1, the tricot knitting yarn 2 and weft in-laid knitting yarn 3, the thickness of total yarns constituting each wale is 84×2+110 (=278) dTex. Because a groove between respective wales formed in this way depends on the size of the weft in-laid knitting yarn 3, the thickness of each groove is substantially 110 dTex.

In the stringer of this embodiment, all composition yarns are composed of a number of filaments and the size of each filament is about ¼ of a conventional filament. Particularly, a bulky processed yarn is used for the weft in-laid knitting yarn 3. Consequently, the stringer has flexibility, and excellent drape performance and soft feeling.

The fixing chain knitting yarns 11, 11 of the two wales $W_2$, $W_3$ disposed in the fastener element attaching portion B are thicker than all the other knitting yarns 1 to 3, 12 and 13 which constitute the fastener tape 4. According to this embodiment, the multifilament yarn is used for the fixing chain knitting yarns 11, 11 as well. According to this embodiment, a single multifilament yarn substantially free of twisting is used as a single fixing chain knitting yarn 11 and the size of the multifilament yarn is 200 dTex and the size of the single fixing chain knitting yarn 11 is set equal to that of the conventional one. However, the total number of filaments of the fixing chain knitting yarns 11 in this embodiment is 100 and the size of each filament thereof is 2.0 dTex, which is not larger than ¼ of the conventional filament.

At this time, the fixing chain knitting yarns 11, 11, the weft in-laid knitting yarn 12 and the inverse in-laid knitting yarn 13 in the fastener element attaching portion B are preferred to use a large filament whose size is 1.5 to 5.0 times larger than that of the yarns in the tape main portion A. On the other hand, for the chain knitting and tricot knitting which constitute the wales including the tape main portion A, the filament of the aforementioned size is used. By combining the composition yarns of such a size and its single filament depending on application purpose appropriately, flexibility in a longitudinal direction of the fastener tape is secured and an excellent feeling of softness is ensured. By providing with some extent of rigidity in the weft direction, touch feeling and drape performance as a stringer and sliding performance of a slider are improved. Further, wrinkle and bending which likely occur in slide fastener manufacturing process are reduced and its rigidity is improved. On the other hand, because the fixing knitting yarn is composed of multiple filaments, the tightening force and stability of elements are improved, so that the entire element coupling portions become elastic and soft. Further, because the size of each filament of the multifilaments which constitute each yarn is ½–¼of an ordinary product, space between yarns becomes invisible, thereby obtaining the stringer having the dense structure.

According to this embodiment, thickness of the wale $W_4$ in its tape piercing direction in the tape main portion A adjacent the wale $W_3$ for fixing the element which is located in the fastener element attaching portion B and closest to the tape main portion is increased so that even if so strong a force which tries to eliminate the coupling between the right and left element rows ER in the hidden type slide fastener is applied, a contact state between the wales $W_4$ is maintained. Thus, according to this embodiment, a thick yarn is used for knitting yarns for forming the wale $W_4$ and, at the same time, a knitting structure which is tightened from the right and left sides to narrow its wale width is adopted. Then, the size of each filament used in this case is as small as that of the filaments used for other wales.

As described above, the fastener tape of this embodiment is comprised of four kinds of knitting structures, that is, the chain knitting yarn 1, 1' and the fixing chain knitting yarn 11 of 1-0/0-1, the tricot knitting yarn 2 of 1-2/1-0 which constitutes the foundation structure of the tape main portion A, the weft in-laid knitting yarn 12 of 0-0/3-3 and the inverse weft in-laid yarn 13 of 2-2/0-0 which is inserted so as to intersect the weft in-laid knitting yarn 12. The chain knitting yarn 1' of this embodiment is composed of two multifilament yarns having 84 dTex and its total size is 84×2(168) dTex and its total number of the filaments is 144. If this is compared with a multifilament yarn having the same size of the conventional one (168 dTex, 36 filaments), it is understood that the composition filament is a very thin filament because the size of each filament is ¼ of the conventional one. By employing the multifilament yarns composed of such a thin filament of the present invention for the chain knitting yarn 1' having the same size as the conventional one, the strictness at a boundary portion between the fastener element attaching portion B and the adjacent tape main portion A can be decreased, thereby securing flexibility.

According to this embodiment, a highly contractible yarn having a dry heat contraction ratio of 8 to 20% is used for the chain knitting yarn 1, 1' and the fixing chain knitting yarn 11 of 1-0/0-1 and the tricot knitting yarn 2 of 1-2/1-0 disposed in the fastener element attaching portion B. On the other hand, for the chain knitting yarn 1, 1' and the fixing chain knitting yarn 11 of 1-0/0-1 and tricot knitting yarn 2 of 1-2/1-0 disposed in the tape main portion A, a yarn having a smaller contraction than the chain knitting yarn 1, 1' and the fixing chain knitting yarn 11 and the tricot knitting yarn 2 of 1-2/1-0 disposed in the fastener element attaching portion B, of which dry heat contraction ratio is 7 to 13%, is used. If the dry heat contraction ratio of the warp knitting yarns which constitute the wales in the fastener element attaching portion B excluding the weft in-laid knitting yarn is higher than the dry heat contraction ratio of the composition yarns of the wales in the tape main portion A excluding the weft in-laid knitting yarn, elements are fixed firmly in the fastener element attaching portion B and the tape configuration is stabilized, and at the same time, a desired flexibility and drape performance in the tape main portion A are obtained.

In the knit-in hidden type slide fastener having the above-described structure in the present invention, the multifilament yarn is used entirely in the fastener tape 4, particularly for the fastener element attaching portion B and the entire fastener tape 4 except wefts such as the weft in-laid knitting yarns 12, 13 and satin knitting yarn (not shown), a multifilament yarn composed of a very thin filament of 1 to 2 dTex is used, and consequently, a slide fastener having flexibility and excellent drape performance and soft feeling is obtained.

The sectional shapes of the wale $W_4$ and the wale $W_5$ in the tape main portion A adjacent the wale $W_4$ are formed larger than that of the other wales in the tape main portion A, and at the same time, those wales $W_4$, $W_5$ are tightened with the weft in-laid knitting yarn 12 and the inverse weft in-laid yarn 13, the thickness of each wale $W_4$, $W_5$ is larger than that of the wales which constitute the other foundation structure. As a result, if the lateral pulling force is applied, the loop of a sewing yarn in a sewed portion hooks on the wales $W_4$, $W_5$ such that the wales $W_4$, $W_5$ do not move further, thereby the bending portion D of the fastener tape 4 being never expanded any further. Accordingly, the continuous element rows ER become more difficult to see from outside. Further, the configuration of a groove formed between the wales $W_4$ and $W_5$ is exposed clearly so that sewing operation to an attachment object is facilitated. Groove width at this time is preferred to be 1 to 1.5 mm in order to prevent a gap from being generated by sewing between the fastener tape and the attachment object.

TABLE 1 shows a test results on flexibility and sliding resistance of sliders according to the hidden type slide fastener of the above-described embodiment and the conventional hidden type slide fastener. The flexibility test was carried out according to the heart loop method based on the "JIS L1018 6.22.4" and the slider sliding resistance was tested according to the "JIS S-3015". In samples of the fastener tape of the above embodiment and the conventional fastener tape, multifilament yarns of the same size having 84 dTex were used as warps (chain knitting yarn and tricot knitting yarn) which constitute the wales on the entire tape and multifilament yarns of the same size having 100 dTex were used as the weft in-laid knitting yarns.

A point which should be noticed here is that the warp of the fastener tape of the embodiment is a multifilament yarn having the size of 84 dTex constituted of 72 filaments while the warp of the conventional fastener tape is a multifilament yarn having the same size of 84 dTex constituted of 24 filaments. Further, as for the weft in-laid knitting yarn, a multifilament yarn of this embodiment is constituted of 48 filaments while a conventional multifilament is constituted of 24 filaments. That is, the size of each composition filament of the warp of this embodiment is 1.67 dTex and the size of each filament of the weft is 2.08 dTex, while the size of each filament of the conventional warp is 3.5 dTex and the size of each filament of the weft is 4.17 dTex. The size of the warp of this embodiment is not larger than ½ of the conventional one and the size of the weft of this embodiment is slightly less than ½ the conventional one.

As evident from TABLE 1, the flexibility and drape performance of the knit-in hidden type slide fastener of the above embodiment are intensified so as to be 60% of that of the conventional slide fastener both on its front and rear surfaces and the sliding resistance of the slider is reduced to about half of the conventional one. As understood from this result, the slide fastener of this embodiment having the excellent flexibility and sliding characteristic adapts well to a fabric of clothes when it is attached to elastic clothes prevailing in recent years, and therefore is easy to sew thereon. Further, after a final product is produced, the slide fastener portion curves smoothly along a body line, so that there is no feeling that it is stretched. Additionally, opening and closing operation by the slider can be carried out smoothly and lightly.

TABLE 1

| | Conventional product | | Present embodiment | |
|---|---|---|---|---|
| | Front | Rear | Front | Rear |
| Flexibility | 4.23 (100%) | 3.29 (100%) | 2.59 (61%) | 2.18 (66%) |
| Sliding resistance | [Open] 4.41 (100%) [Close] 3.88 (100%) | | [Open] 2.24 (51%) [Close] 2.29 (59%) | |

Figure 4:
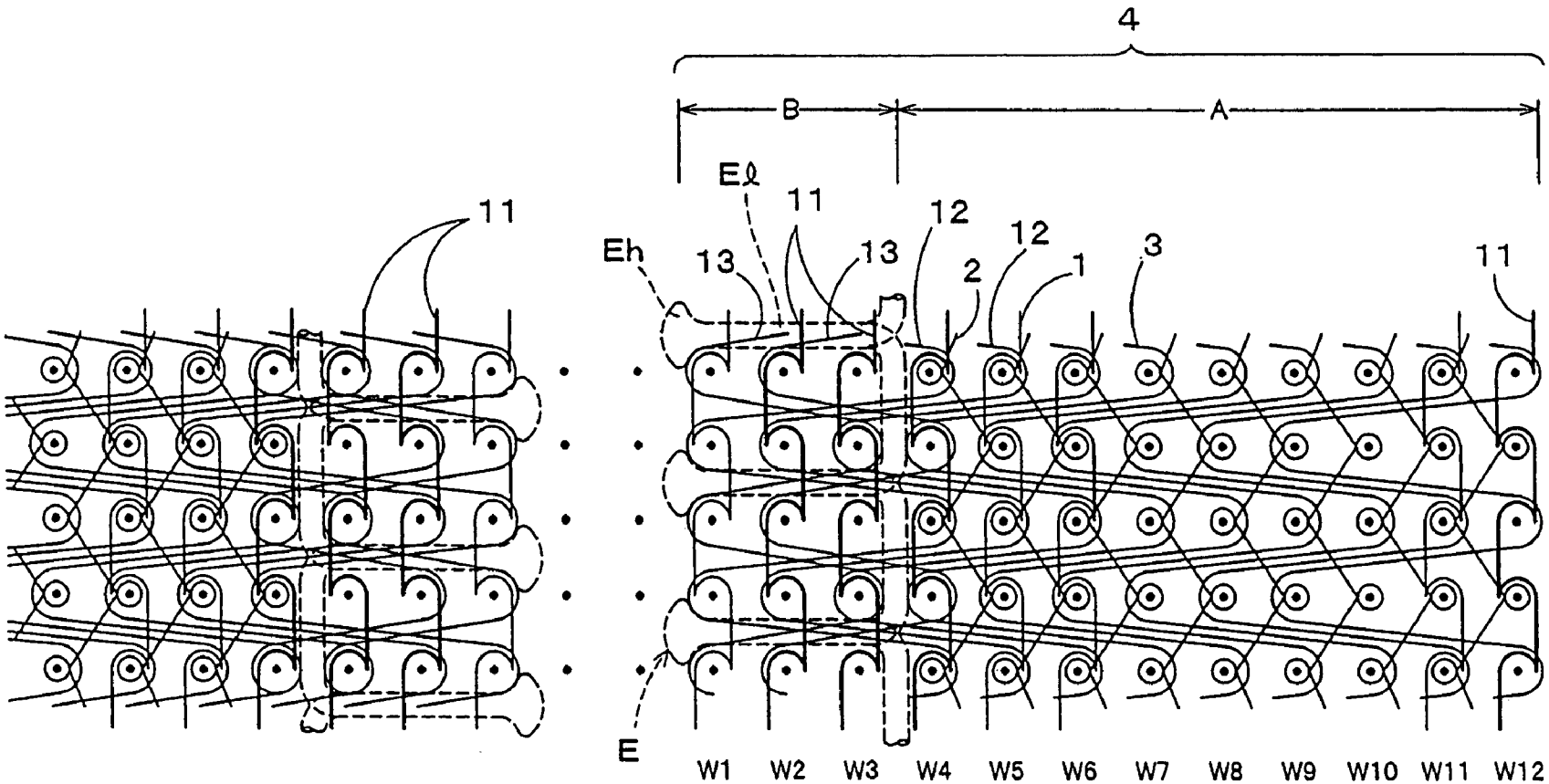
FIG. 4 is a warp knitting structure diagram showing a modification of the stringer.

FIG. 4 shows the entire warp knitting structure of the second embodiment of the stringer obtained by knitting continuous coil-shaped elements at the same time when a fastener tape is knit like the above-described embodiment. The stringer of this embodiment is a stringer of ordinary slide fastener, which is different from the hidden type slide fastener stringer of the above-described embodiment.

That is, according to the second embodiment, the coupling head Eh of each element E in the continuous element row ER to be knit into the fastener tape protrudes outside from an edge of the fastener element attaching portion B of the fastener tape when that element row is knit in the fastener tape. Then, each leg portion E1 is tightened and fixed to the foundation structure with the fixing chain knitting yarn 11. Further, according to this embodiment, the knitting structures of the weft in-laid knitting yarn 3 in the tape main portion A and the weft in-laid knitting yarn 12 in the fastener element attaching portion B are constructed in the form of 0-0/4-4 and the knitting structure of the inverse weft in-laid knitting yarn 13 is constructed in the form of 3-3/0-0 as shown in the same figure. As a yarn extending in a tape width direction, a satin yarn (not shown) may be adopted. Another organizations are substantially not different from the above-described embodiment.

Also according to the second embodiment, the multifilament yarns constituted of a number of fine filaments are used like the embodiment shown in FIG. 1 for the chain knitting yarn 1, the fixing chain knitting yarn 11 and the tricot knitting yarn 2 which constitute the wale and the weft in-laid knitting yarn 3, 12 and inverse weft in-laid knitting yarn 13 extending in the width direction of the fastener tape and disposed in the tape main portion A and the fastener element attaching portion B. Furthermore, according to this embodiment as well, the dry heat contraction ratio of yarns which constitute the fastener element attaching portion B is set to 15% while the dry head contraction ratio of yarns which constitute the tape main portion A is set to 10%, so that the dry heat contraction ratio of the yarns which constitute the fastener element attaching portion B is higher than that of the yarns which constitute the tape main portion A. Additionally, according to this embodiment also, the bulky textured yarn is used for the fixing chain knitting yarns 11 disposed in the fastener element attaching portion B as well as the wefts extending in the width direction of the fastener tape.

With such a structure, the stringer of the second embodiment entirely ensures excellent flexibility and feeling of softness and adapts well and fits well to a fabric when it is sewed onto soft child clothes, for example. Further, since the bulky textured yarn is used for the fixing chain knitting yarn 11 disposed in the fastener element attaching portion B as well as the weft extending in the width direction of the fastener tape, even if the rear surface of the slide fastener makes a contact with the skin, it provides soft feeling but not feeling of rigidity.

Figure 5:
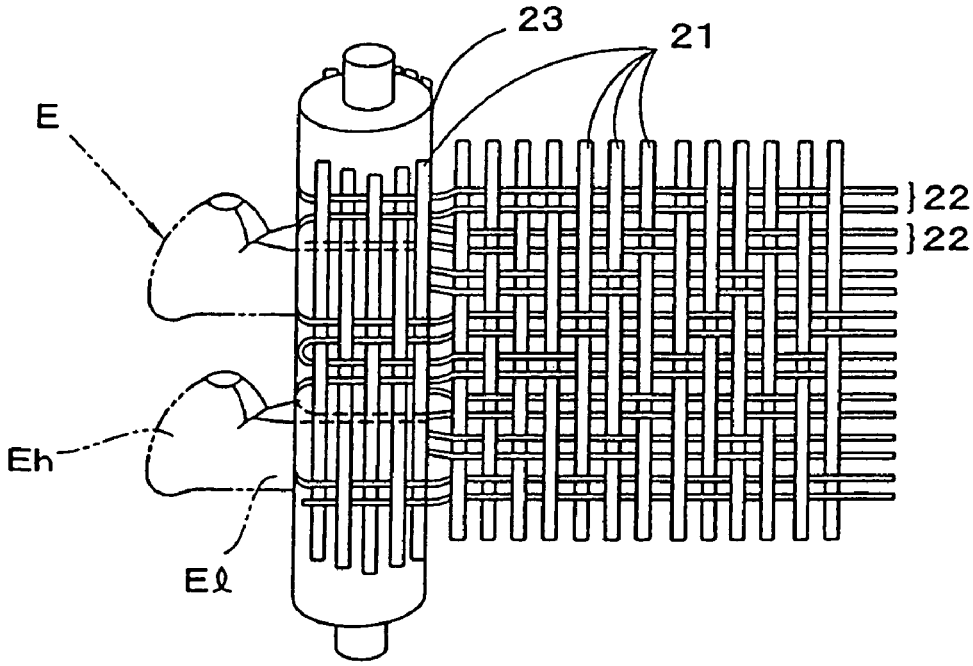
FIG. 5 is an entire weaving structure diagram schematically showing an example of a weaving structure of a woven-in slide fastener stringer of the present invention.

FIG. 5 schematically shows a structure of a woven fastener tape according to a third embodiment of the present invention. The fastener tape shown in the same figure is woven with a narrow weaving machine which completes one weft beating by reciprocating the weft within the same opening of the warp with a carrier. Thus, the weft to be beaten in one time is constituted of two yarns. In an example in the figure, a weft 22 is constituted of one weft yarn with two yarns doubled over each other. The tape main portion A is woven with 3/1 twill weaving structure and the fastener element attaching portion B is woven with fancy fabric weaving structure into a bag (cylinder) while a core thread 23 made of a knit thread or twisted thread is inserted into and integrated with the cylinder so as to form a core portion.

For both warp 21 and weft 22, multifilament yarn composed of a number of filaments are used. According to this embodiment also, a size of each filament which constitutes the warp 21 and the weft 22 is set to not larger than ¼ of the size of each composition filament of the conventional multifilament yarn. The warp 21 is a multifilament yarn having the total size of 167 dTex and constituted of 96 filaments, and the weft 22 is a multifilament yarn of the same size as that of the warp 21. However total size of the weft 22 is double of the warp 21 because the weft 22 is constituted of two yarns. Total number of filaments which constitutes the weft is 96, which is the same as the warp 21. If it is converted to the size of each filament, the size of a single filament of the warp 21 is 1.74 dTex and the size of a single filament of the weft 22 is 3.48 dTex, which are not larger than ¼ of the sizes of the conventional warp and weft.

The yarns used as the core thread 23 woven into the fastener element attaching portion B at the same time when the tape is woven employs a multifilament yarn having high flexibility like the other composition yarns. This multifilament yarn also employs a filament having a size as small as about 5 dTex. The multifilament yarn composed of such an extremely fine filament can provide the core thread with flexibility so that the entire slide fastener becomes elastic. Further, according to this embodiment, the bulky processed textured yarn is employed for all the warps 21 and wefts 22. For the reason, a woven fastener tape which usually provides a feeling of coldness can be provided with a very warm and soft texture, so that a slide fastener having flexibility and excellent drape performance and soft feeling, which does not looks like a woven fastener at first sight, can be obtained.

A number of individual elements E are attached to the fastener element attaching portion B at a predetermined interval along the core portion so as to construct a stringer. The material of the element E to be attached is thermoplastic resin, such as polyester resin, or metal. The attachment of the thermoplastic resin is carried out by forming the element E by injecting molten resin into an injection mold with a fastener tape passing through it and at the same time by adhering and integrating with a core thread portion of the fastener tape. The attachment of the metallic elements E is carried out according to either of the following methods. According to one method, individual elements E are produced preliminarily and fixed to the core thread portion so that it is integrated therewith by crimping its leg portion E1 to the core thread portion of the fastener tape. According to the other method, a metallic wire having an irregular section such as a letter Y is cut out and the leg portion is crimped to the core thread portion of the fastener tape while the coupling head Eh and the leg portion E1 are formed, so that those elements are fixed on and integrated with the fastener tape continuously.

Figure 6:
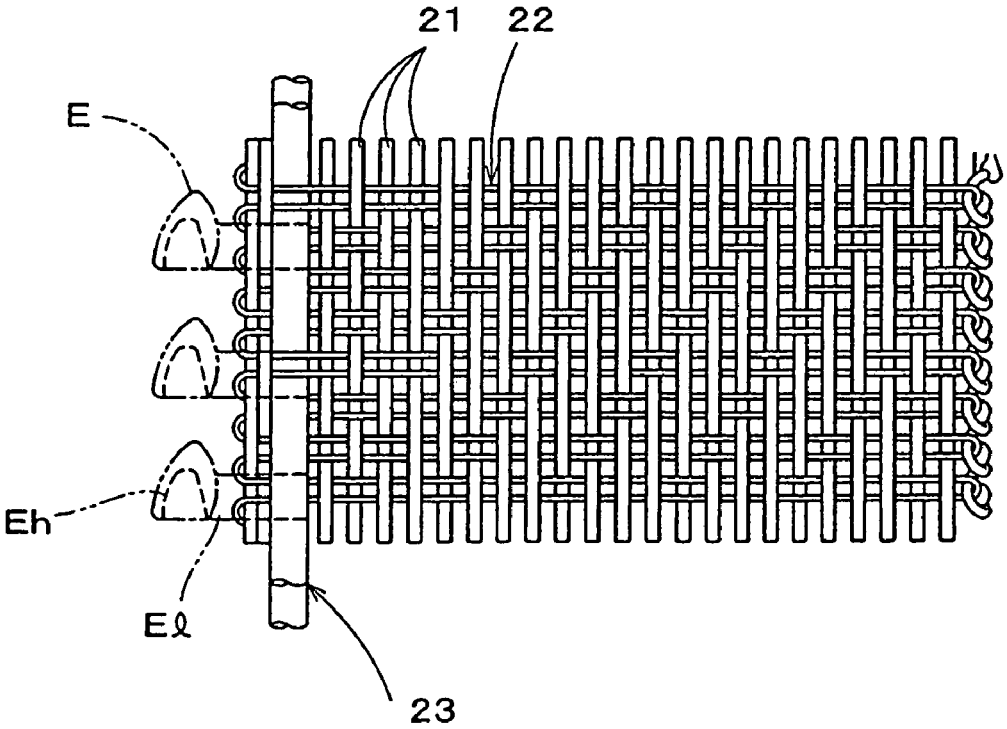
FIG. 6 is an entire weaving structure diagram schematically showing a modification of the stringer.

FIG. 6 schematically shows an example of a structure of another woven fastener tape. In the fastener tape of this example, the tape main portion A employs the same 3/1 twill weaving structure as shown in FIG. 5 and the fastener element attaching portion B except the core thread portion employs a plain weaving structure. In the core thread portion, two core threads 22 doubled over each other stride over three wefts (double yarns each) and submerge under a weft 22 and then by repeating this cycle, the core thread is woven into the fastener tape. Also according to this embodiment, all the yarns to be used are multifilament yarns and the size of a single filament of a number of filaments which constitute the multifilament yarn is very small like the above-described embodiments.

The slide fastener produced with the fastener tape obtained in this way has excellent flexibility and soft feeling like the warp knit fastener tape of the above-described embodiment, so that it adapts well to thin and soft clothes. When the slide fastener is sewed to a fabric, it can be sewed smoothly along a sewing line on the fabric without damaging a sewing needle.

Figure 7:
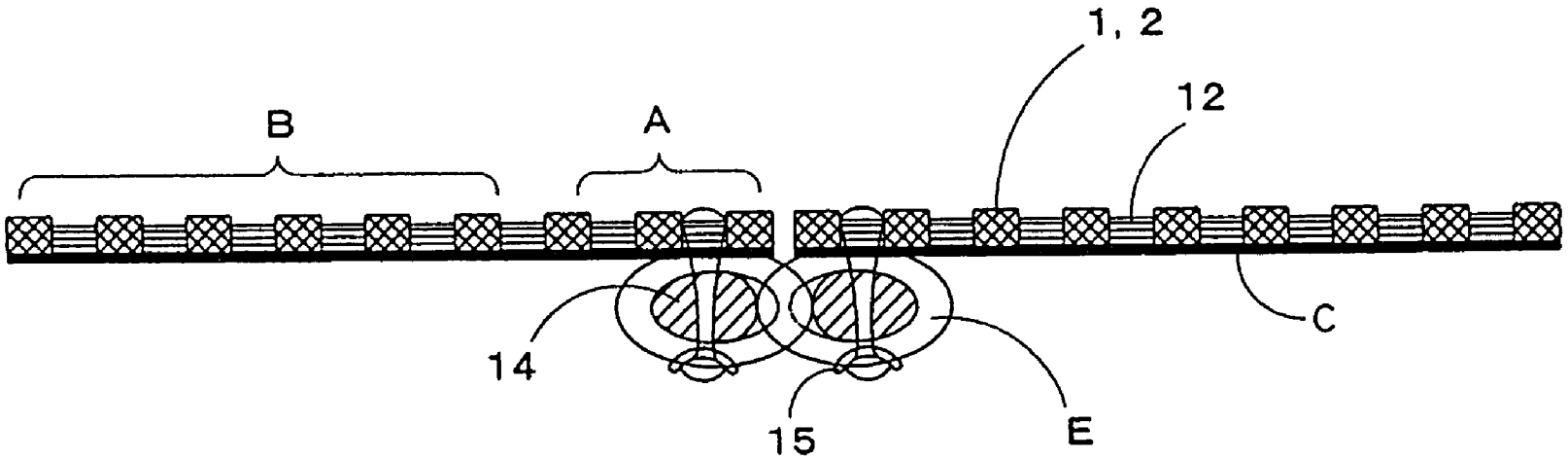
FIG. 7 is a lateral sectional view schematically showing an example of an attachment structure of a warp knit stringer on which continuous element rows are attached by sewing.
Figure 8:
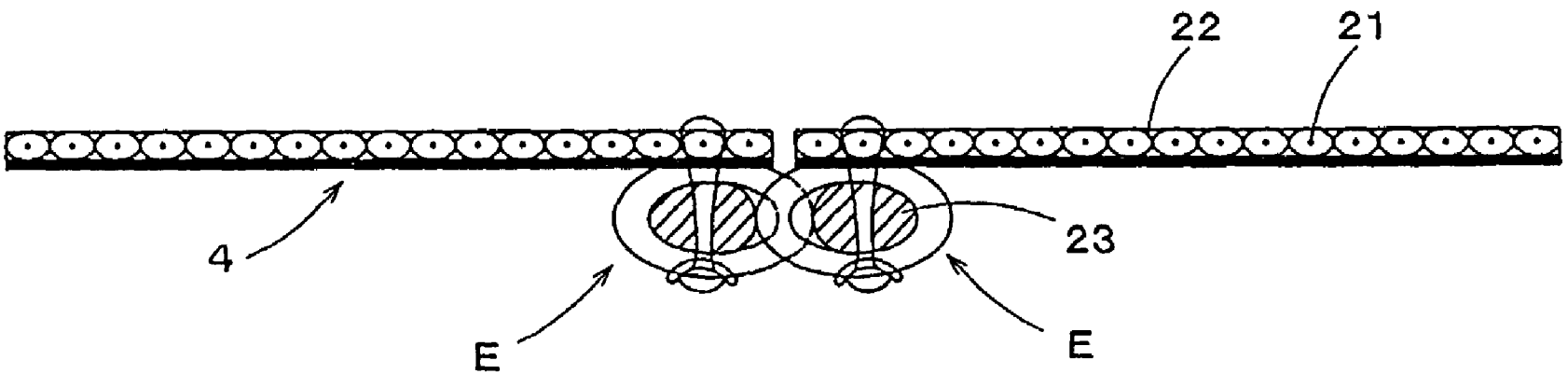
FIG. 8 is a lateral sectional view schematically showing an example of an attachment structure of a woven stringer on which the continuous element rows are attached by sewing.

In the warp knit tape of the first and second embodiments shown in FIGS. 1 to 4, the coil-shaped continuous elements composed of synthetic resin monofilament are knit into the fastener tape at the same time when the fastener tape is knit. In the fastener tape shown in FIGS. 5 and 6, the synthetic resin or metallic elements E are attached individually by injection molding or crimping. However, the aforementioned elements composed of the monofilament can be attached by weaving into a woven fastener tape at the same time when it is woven and further, the elements can be attached individually to the warp knit fastener tape. Moreover, as shown in FIGS. 7 and 8, the element row ER composed of a number of continuous elements formed from the monofilament can be attached to the warp knit or woven fastener tape by sewing. In the stringer shown in FIGS. 7 and 8, the core thread 14 runs through an internal hollow portion in the element row ER formed in a coil-like shape. The upper/lower leg portions of each element E are tightened with a sewing yarn 15 so that the core thread 14 and the fastener tape are bind together.

The fastener tape and stringer of the present invention can adopt various kinds of the knitting/weaving structures and various kinds of materials, shapes and structures can be adopted as the elements to be attached to the fastener tape. As the material to be used, metal and synthetic resin can be selected depending on application and the present invention is not restricted to the above-described embodiments.

What is claimed is:

1. A fastener tape for a slide fastener, which is constituted of a warp knitting structure or a weaving structure and comprises a tape main portion and a fastener element attaching portion, wherein a warp and a weft, which are composition yarns of the fastener tape, are composed of multifilament yarns, a size of a single composition filament of the warp is 1.0 to 2.0 dTex, and a size of a single composition filament of the weft is 2.0 to 5.0 dTex.

2. The fastener tape according to claim 1, wherein the size of the single composition filament of the weft is 2.0 to 4.5 dTex.

3. The fastener tape according to claim 1, wherein dry heat contraction ratio of yarns which constitute the fastener element attaching portion is 10 to 20%, and dry heat contraction ratio of yarns which constitute the tape main portion is 7 to 13%.

4. The fastener tape according to claim 1 or 3, wherein a core thread is woven or knit into the fastener element attaching portion at the same time when the fastener tape is knit or woven.

5. A slide fastener stringer comprising a plurality of fastener elements along a fastener element attaching portion of the fastener tape according to claim 1 or 3, wherein the plurality of fastener elements are formed by continuously weaving or knitting a single monofilament into the fastener tape at the same time when the fastener tape is knit or woven, each of the fastener elements is fixed to the fastener element attaching portion with a warp for fixing the fastener element and the warp for fixing the fastener element is constituted of a yarn having a size 1.5 to 5.0 times larger than that of a warp which is a composition yarn of the tape main portion.

6. A slide fastener stringer comprising a plurality of fastener elements along a fastener element attaching portion of the fastener tape according to claim 1 or 3, wherein the plurality of fastener elements are constituted of a continuous element row formed from a single synthetic resin monofilament, and the element row is attached to the fastener element attaching portion of the fastener tape by sewing.

7. The slide fastener stringer according to claim 6, wherein the fastener element row is formed into a coil-shaped configuration and a core thread is inserted into an internal hollow portion in the coil-shaped fastener element row.

8. The slide fastener stringer having a plurality of fastener elements attached thereto along the fastener element attaching portion of the fastener tape according to claim 4, wherein the fastener elements are composed of a metallic material.

* * * * *